US006255613B1

(12) United States Patent
Yang

(10) Patent No.: US 6,255,613 B1
(45) Date of Patent: Jul. 3, 2001

(54) REVISED STRUCTURE FOR ON-LINE SWITCH

(75) Inventor: Wen Ho Yang, Taipei Hsien (TW)

(73) Assignee: Sun Lite Sockets Industry Inc., Taoyuan Hsien (TW)

( * ) Notice: Subject to any disclaimer, the term of this patent is extended or adjusted under 35 U.S.C. 154(b) by 0 days.

(21) Appl. No.: 09/657,572

(22) Filed: Sep. 8, 2000

(51) Int. Cl.[7] ..... H01H 21/00
(52) U.S. Cl. ..... 200/553; 439/455
(58) Field of Search ..... 200/83, 84, 293–303; 439/455–457, 465, 466, 468, 473, 942

(56) References Cited

U.S. PATENT DOCUMENTS 2,038,902 * 4/1936 Peterson ..... 200/67
3,317,688 * 5/1967 Cherry et al. ..... 200/67
6,005,210 * 12/1999 Chien ..... 200/438
6,051,801 * 4/2000 Wang ..... 200/571

* cited by examiner

*Primary Examiner*—M. L. Gellner
*Assistant Examiner*—Nhung Nguyen
(74) *Attorney, Agent, or Firm*—Bacon & Thomas, PLLC

(57) ABSTRACT

A revised structure of a distribution box of an on-line switch essentially comprised of a distribution box base, wherein four separated wire slots are formed and the left, right and base of the slot are in the shapes triangular of pyramid convexes, a box cover, wherein wire-pressing convexes which correspond to the convexes of the distribution box base are made, and a control element, which is inserted in the space created after the distribution box base and the box cover; after the electric wire being inserted in the wire slots and the distribution base and the box cover being assembled, the convexes can compress the electric wires in four directions and in turn grip the electric wires firmly, preventing the electric wires the risks form loosening, or even falling off, under improper pulling.

1 Claim, 4 Drawing Sheets

(A-A)

REVISED STRUCTURE FOR ON-LINE SWITCH

BACKGROUND OF THE INVENTION

1. Field of the Invention

The present invention relates to a revised structure of an on-line switch, and more particularly to one that helps ensure the safety of the on-line switch, by preventing electric wires connected with the on-line switch from loosening or even falling off.

2. Description of the Prior Art

Although there are many types of conventioal on-line switches, the basic structure is comprised of a distribution box body 1 and a box cover 2, which can be fastened to the distribution box body 1 (as shown in FIG. 1) for positioning; a control space created after the distribution box body 1 and the box cover 2 being fastened together can be used to accommodate a control element 3 (the controlling modes may be sliding, levering, or pressing, and so on.). The front and back of the distribution box body 1 and the box cover 2, which corresponds the control element 3, form wire slots 30, allowing an exposed wire 40 on the end of an electric wire 4 to enter and connect to the control element 3, and providing the function of connecting, with the electric wire 4.

The conventional on-line switch of which the control element 3 can control on and off of the electric wire 4, and consequently provide convenient controlling function for associated appliances (such as lamps, electric fans. . . ). However, the conventional on-line switch obviously has some unsatisfactory considerations in safety; because the on-line switch is installed on the wire, not on the appliances; the firmness of the on-line switch should be particularly important, Therefore, should the on-line switch be secured firmly, the current transmission in the wire would be stable and safe. However, the wire slots 30 provided by the switch box 1 and the box cover 2 can only form a passage for a plastic sheath 41 of the electric wire 4, but cannot the grip plastic sheath 41 in position. Therefore, when the electric wire 4 is under improper pulling, connection between the exposed wire 40 on the end of the electric wire 4 and the control element 3 would be loosening, or even falling off, and, as a result, the controlling function of the on-line switch would be lost. Thus, the conventional on-line switch is unsatisfactorily designed in this regard. In particular, if the improper pulling causes the electric wire 4 loosening, but not falling off, the transmitting current in the electric wire 4 would be unstable; it is possible that the operating current in the electric wire 4 becomes too large and causes overheat, or even fire.

The design of the conventional on-line switch obviously does not consider the importance in gripping electric wire firmly, posing huge potential risk in use, and the design, therefore, should be improved,

SUMMARY OF THE INVENTION

The present invention is to provide a revised structure for an on-line switch. In particularly, inside the distribution box of the on-line switch are four different and separated wire slots in the place where an electric wire passes through. The left, right, and base of the slots are designed to be triangular-pyramid gripping convexes. Moreover, the gripping convex, situated in the base of the slot is a gripping structure, Which is a V-shape of slightly inward. The cover of the box, which corresponds the gripping structures of the distribution box, has wire-pressing convexes to press the electric wire after the electric wire being inserted to the wire slots and the box cover being mounted. The insulated sheath of the electric wire will deform slightly after being pressed downwards by the wire-pressing convexes; consequently, the deformed wire can envelope the gripping convexes around the wire slots. In the mean time, the gripping force on the upper, lower, left, and right sides of the electric wire is so large that the electric wire can be firmly secured in position. Therefore, the risk of loosening, or even falling, electric wires caused by improperly applied pulling force can be effectively prevented.

DETAILED DESCRIPTION OF THE INVENTION

The present invention is to provide a revised structure for an on-line switch. More particular, the structure is an on-line switch, which can effectively provide the function of gripping an electric wire in position. When the electric wire is under improper pulling, the structure can prevent the connection, in which the exposed wire on the end of the electric wire is screwed with the on-line switch, from loosening or falling off and ensure the safety of users.

Therefore, the primary purpose of the present invention is to provide an improved structure of the on-line switch, offering a function of gripping electric wire firmly in position to prevent risk from improper pulling of the electric wire and to ensure the safety in using electricity.

To achieve the purpose described above, one of the preferred embodiments of the present invention is illustrated with the accompanying figures below to render further insight to the reviewing committee.

Figure 1:
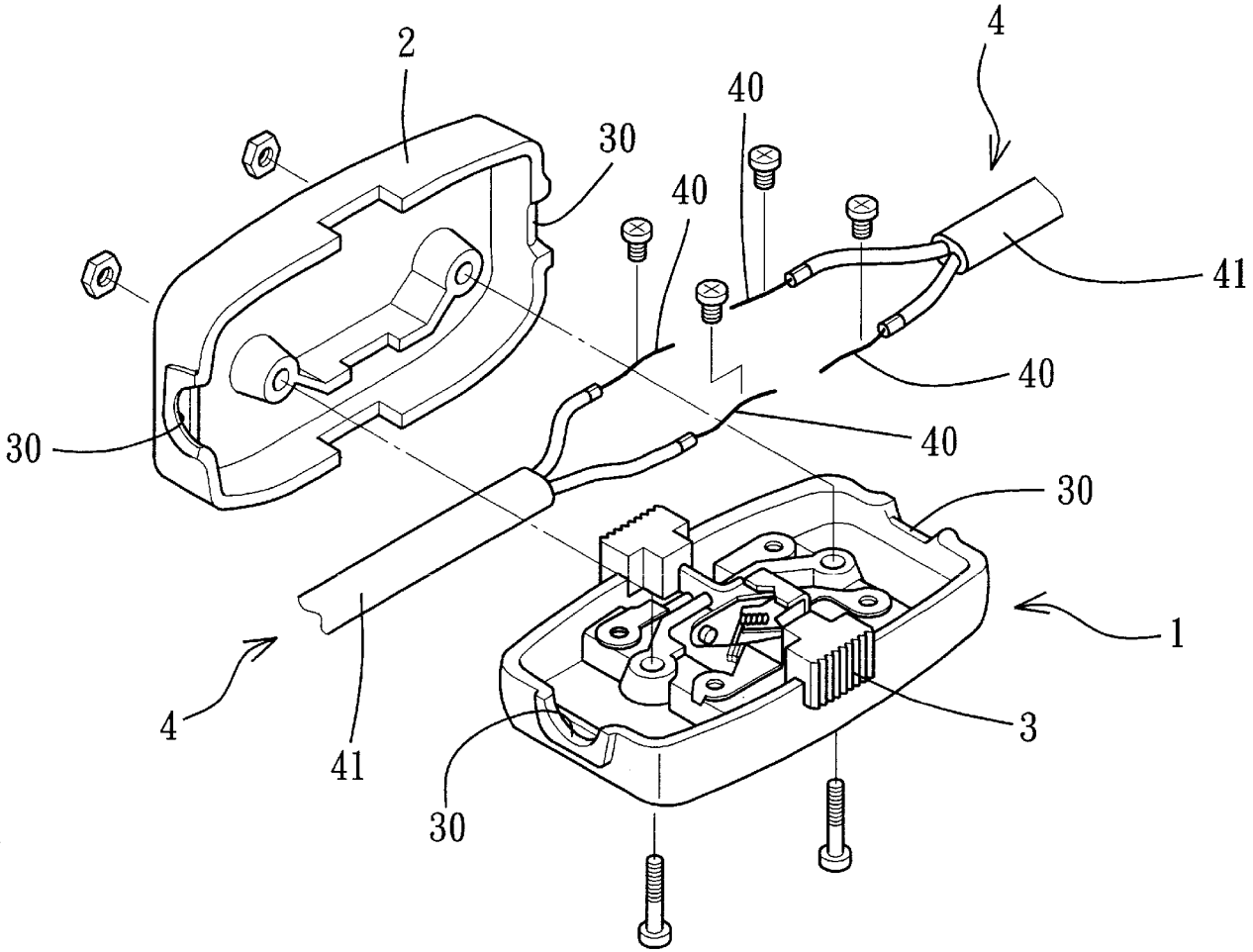
FIG. 1 (PRIOR ART)
FIG. 1 is a schematic view showing the conventional on-line switch.
Figure 3:
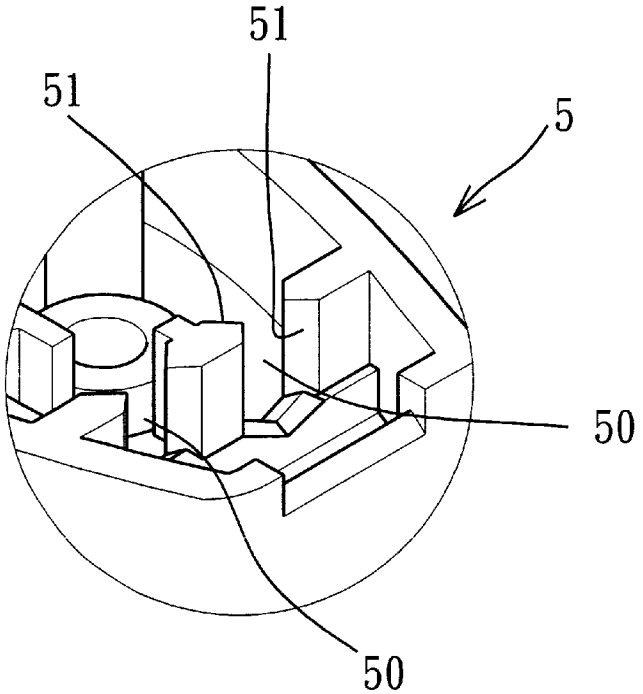
FIG. 3 is a schematic view showing the enlargement of the area A in FIG. 2.
Figure 2:
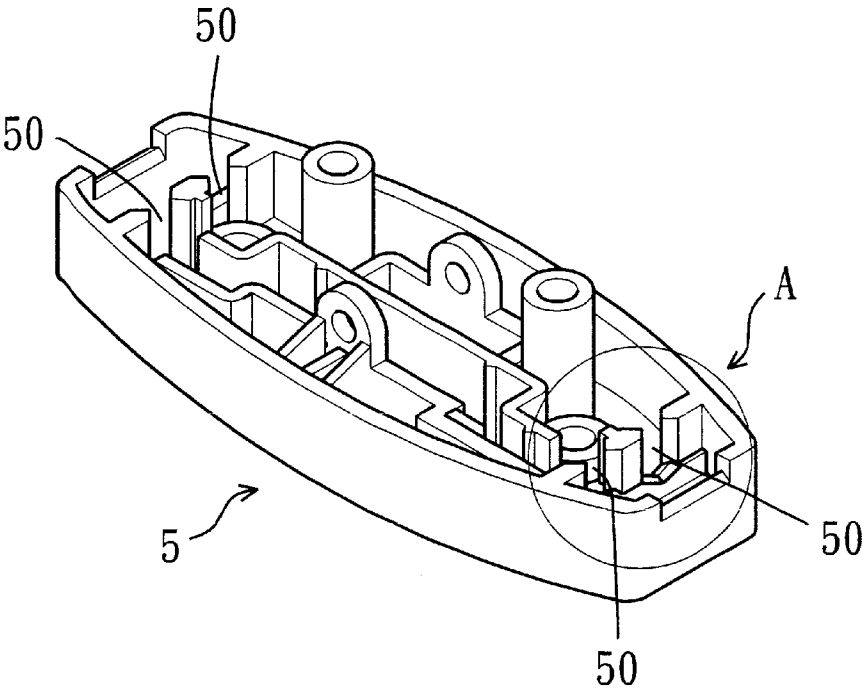
FIG. 2 is a schematic view showing the structure of the distribution box of the on-line switch for the embodiment of the present invention.
Figure 6:
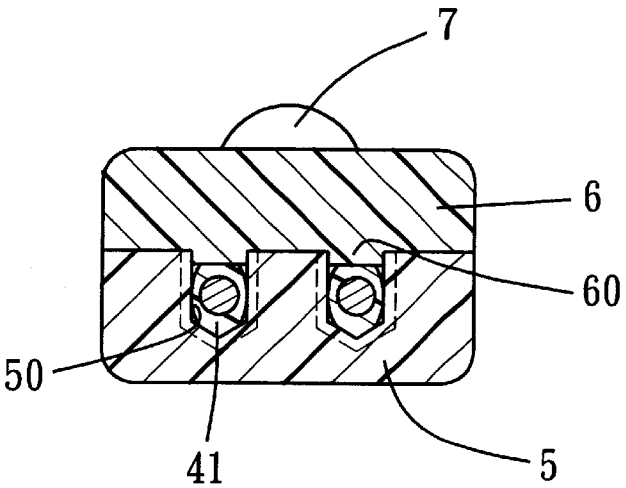
FIG. 6 is a schematic view showing A—A section in FIG. 2.
Figure 4:
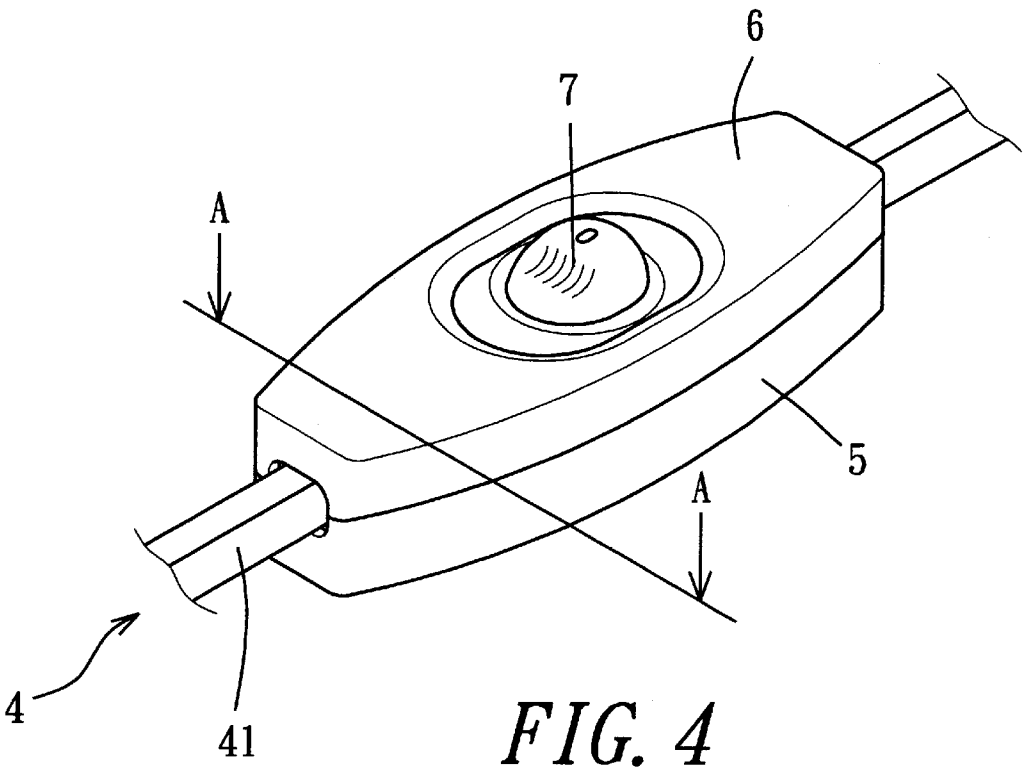
FIG. 4 is a sectional view showing the assembly of the distribution box base and the box cover for the embodiment of the present invention.
Figure 5:
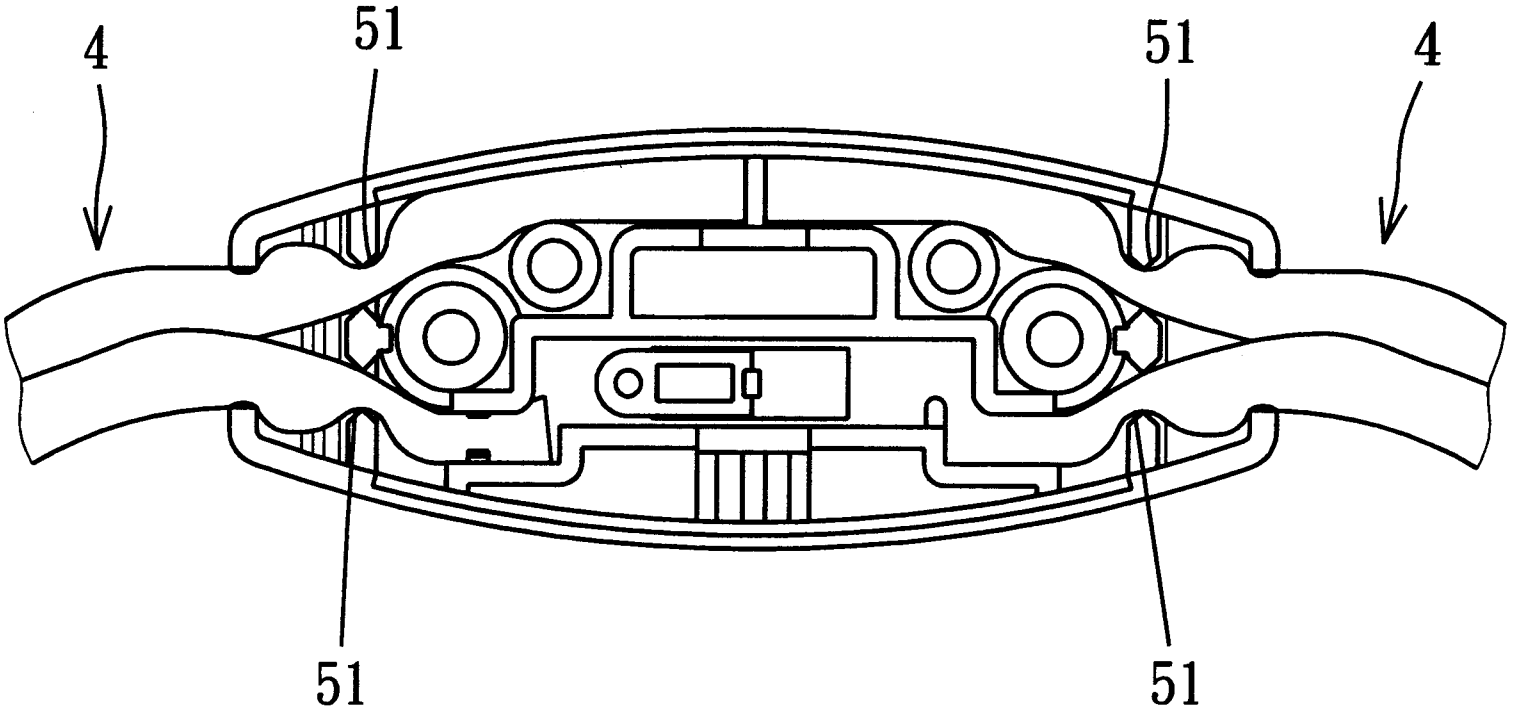
FIG. 5 is a schematic view showing the electric wire being gripped for the embodiment of the present invention.

Referring to FIG. 2 showing the illustrated structure of the distribution box base 5 of the preferred embodiment of the present invention, the main structure feature of the distribution box base 5 is that, inside the distribution box of the on-line switch 5 are four different and separated wire slots in the place where the electric wire passes through. The left, right, and base of the wire slots 50 are designed to be triangular-pyramid gripping convexes 51. Also, the gripping convex 51, situated in the base of the wire slot 50 is a gripping structure which is a V-shape of slightly inward, Moreover, the inner of the box cover 6 (please refer to FIGS. 4 and 5), which corresponds the gripping structures of the distribution box 5, is made with wire-pressing convexes 60 (please refer to FIG. 6). Therefore, upon inserting the electric wire 4, the insulated sheath 41 of the electric wire 4 can be set appropriately in the wire slot 50 of the distribution box 5. If the box cover 6 is mounted, the wire-pressing convexes 60 of the box cover 6 rest appropriately in the wire slots 50 and presses the insulated sheath 41 of the electric wire 4. After being pressed downwards by the wire-pressing convexes 60, the insulated sheath 41 is deformed slightly (note: the insulated sheath 41 of the electric wire 4 has adequate ductility intrinsically.) to envelop the whole triangular-pyramid gripping convexes 51 around the wire slot 50*s* (as shown FIG. 5). The gripping force on the upper, lower, left, and right sides of the electric wire 4 is very large after the box cover 6 being mounted in position on the distribution box 5. Therefore, even if improper pulling force is applied on the electric wire 4, the exposed wire 40 on the end of the electric wire 4 will not fall off from the on-line switch (i.e., the space provided by the box base 5 and the box cover 6). Firm contact between the electric wire 4 and the control element 7 of the on-line switch, and thus the controlling function for electricity transmission, can be ensured. This firm contact can essentially prevent the risk of loosening electric wire from infirm gripping on electric wire in the conventional on-line switch.

From the above explanation, the preferred embodiment of the present invention can prevent the risk of loosening electric wire from infirm gripping on electric wire in the conventional on-line switch, providing improvement and advance in function. Also, the present invention needs no external gripping part to grip electric wire firmly in position, meeting the demand of achieving high added value in industrial application with low cost. Thus the present invention is indeed a practical, advanced, and novel invention.

To sum up, this present invention is indeed progressive in nature and highly applicable in industry, Also, the characteristics of the present invention have never been seen in the structures of similar items elsewhere, and its novelty has met the necessary requirements of the Utility Model Patent. We, therefore, put forward the application of the present invention for the Utility Model Patent accordingly and hope sincerely this application could be granted after your review.

It is noted that the above description is only one of the preferred embodiments of the present invention and therefore cannot be taken to restrict the scope of the application of the present invention. Any variations and modifications based the methods in the scope of the present invention should be regard as within the scope of the present invention.

What is claimed is:

1. An improved structure is comprised of a distribution box body and a box cover, which is fastened to the distribution box body for positioning; a control space created after the distribution box body the box cover being fastened together is used to accommodate a control element. The front and back of the distribution box body and the box cover, which correspond the control element, form wire slots, allowing an exposed wire on the end of an electric wire to enter and connect to the control element, and providing all the switch-controlling functions of an on-line switch.

The characteristics of the present invention are described as follows. Inside the distribution box of the on-line switch are four different and separated wire slots in the place where the electric wire passes through. The left, right and base of the slots are designed to be triangular-pyramid gripping convexes. Moreover, the gripping convex, situated in the base of the slot is a gripping structure, which is a V-shape of slightly inward. The cover of the box, which corresponds the gripping structures of the distribution box, has wire-pressing convexes to press the electric wire after the electric wire being inserted to the wire slots and the box cover being mounted. The insulated sheath of the electric wire will deform slightly after being pressed downwards by the wire-pressing convexes; consequently, the deformed wire can envelope the gripping convexes around the wire slots. In the mean time, the gripping force on the upper, lower, left, and right sides of the electric wire is so large that the electric wire is firmly secured in position. Therefore, the risk of loosening, or even falling, electric wires caused by improperly applied pulling force is effectively prevented.

* * * * *